US005483117A

United States Patent [19]

Rohrer

[11] Patent Number: 5,483,117

[45] Date of Patent: Jan. 9, 1996

[54] DEVICE FOR NON-THERMAL EXCITATION AND IONIZATION OF VAPORS AND GASES

[76] Inventor: Ernst Rohrer, Boden, CH-9470 Buchs, Switzerland

[21] Appl. No.: 198,115

[22] Filed: Feb. 17, 1994

[30] Foreign Application Priority Data

Feb. 19, 1993 [CH] Switzerland ..... 529/93

[51] Int. Cl.[6] ..... H01J 1/02; H01T 23/00

[52] U.S. Cl. ..... 313/306; 313/307; 313/352; 313/357; 361/230

[58] Field of Search ..... 313/306, 307, 313/352, 356, 357, 360, 231.31, 325, 362.1; 250/324; 361/230

[56] References Cited

U.S. PATENT DOCUMENTS 3,908,123 11/1975 Veach et al. .
3,985,636 1/1976 Schneider .
4,126,434 11/1978 Keiichi .
4,375,364 3/1983 Van Hoesen et al. ..... 361/230
4,910,637 3/1990 Hanna ..... 361/230
4,940,894 7/1990 Morters .
5,061,462 10/1991 Suzuki .
5,242,587 9/1993 Barrington et al. .

FOREIGN PATENT DOCUMENTS 1001239 1/1957 Germany .

*Primary Examiner*—Sandra L. O'Shea
*Assistant Examiner*—Vip Patel
*Attorney, Agent, or Firm*—Cooper & Dunham

[57] ABSTRACT

The excitation device comprises a plurality of rod-like electrode elements. Each electrode element is enclosed by a chemically and thermally stable protective casing, which can be exposed to high electric fields. The electrode elements are held in vertically extending crosspieces. This results in a setup of several modules, each of which consists of a plurality of electrode elements and two cross pieces. The electrode elements of each module are electrically connected to a conductive bar and have equal potential. Consecutive modules are alternately connected to ground or phase, respectively.

10 Claims, 4 Drawing Sheets

DEVICE FOR NON-THERMAL EXCITATION AND IONIZATION OF VAPORS AND GASES

BACKGROUND OF THE INVENTION

1. Field of the Invention

The invention relates to a device for non-thermal excitation and ionization of vapors and gases. The non-thermal excitation of vapors and gases is widely used in industrial applications for the cracking and decomposition as well as for the synthesis of simple and highly molecular compounds of organic and inorganic nature.

2. Description of the Prior Art

Because they can be controlled easily, it is preferred to use electric fields and discharges for excitation. Discharges are electric currents through a gas. Based on their current-voltage characteristics, they are divided into different types, such as Townsend (independent or induced dark discharges), corona or barrier discharges, normal and abnormal glow, spark, and arc discharges.

Technically, (cold plasma) corona and glow discharges are used for weak excitations up to multi stage excitations. Spark and arc discharges cannot be used in non-thermal methods.

So far known excitation devices can be divided into two basic types: devices with plate-like, flat electrodes and devices with concentric, tube-like electrodes.

The excitation, the partial or the complete ionization of the gazes often leads to the formation of clusters, which are combining into aggregates and aerosols due to collisions and finally form larger droplets. Experience shows that condensation on the discharge surfaces also in humid gases (decrease of the dew-point). Such condensates, which are deposited on the electrodes or their coatings, respectively, can strongly influence the current transition by local modification of the electrical resistance. In this way a local increase of the conductivity, e.g. due to water droplets, can lead to local spark discharges, break through and even arc discharges. This leads to a damage of the barriers or the coatings, respectively, of the electrodes, to increased current consumption and to an undesired heating.

Depending on the gas composition a polymerization can occur as well, resulting in a fog of polymers, which is deposited on the electrodes or the dielectric and modifies the discharge conditions. Such effects are e.g. known from the treatment of styrene or ethylene oxide containing vapors. During excitation of such gases, the polymerization of the monomers is started and, after a short time, the barrier material and/or the electrodes are coated by a polymer layer. As a consequence, an additional isolating layer is formed and the discharges loose their intensity.

SUMMARY OF THE INVENTION

Hence, it is a general object of the invention to provide a device for the excitation of vapors and gases that does not have these disadvantages. Especially, the device should allow the treatment of humid and polymerizing vapors.

Now, in order to implement these and still further objects of the invention, which will become more readily apparent as the description proceeds, the device for the excitation of vapors and gases is manifested by the features that its electrodes comprise a plurality of rod-shaped electrode elements, wherein each of said electrode elements is enclosed in a protective casing.

A preferred embodiment of the excitation cell is derived from the principle of parallel plate electrodes. At least one plate electrode is divided into a larger number of smaller, rod-like electrode elements. Each electrode element is surrounded by a protective casing. The protective casing is preferably made from a chemically and thermally stable material that is also insensitive to electric fields and discharges.

An advantage of the inventive excitation cell lies in the fact that even at low flow rates the gas flow is non-laminar. Therefore, most deposits on the protective casings of the electrodes are prevented, because the condensate is not deposited at all or is immediately blow off when it settles on a casing.

In a preferred embodiment of the device the arrangement of the electrodes is chosen such that any deposited drops of condensate are brought, by gravity or gas flow, into a part of the protective casing where the electric field is small and where they will not affect the discharge process.

Because of the division of the electrodes into many small electrode elements with their own protective barriers, the costs of repair are reduced. If a protective casing of an electrode element is e.g. damaged by uncontrolled arc discharge, it is sufficient to replace this individual electrode element or its protective casing, respectively. Replacing such a small element is comparatively cheap. In conventional devices a whole electrode or its barrier, respectively, must be replaced in such a repair. Because these are much larger elements, the costs are correspondingly higher.

By suitable arrangement of the electrode elements and choice of the support means a cell can be constructed in such a way that the distance of the electrodes and hence the strength of the field can be varied by easy mechanical manipulation. This allows a simple adjustment of the field strength to the current needs of operation and makes it possible to reach very high fields.

BRIEF DESCRIPTION OF THE DRAWING

The invention will be better understood and objects other than those set forth above will become apparent when consideration is given to the following detailed description thereof. Such description makes reference to the annexed drawings, wherein:

FIG. 6A is a cross-sectional view taken along the line A—A of FIG. 6.

DESCRIPTION OF THE PREFERRED EMBODIMENTS

Figure 1:
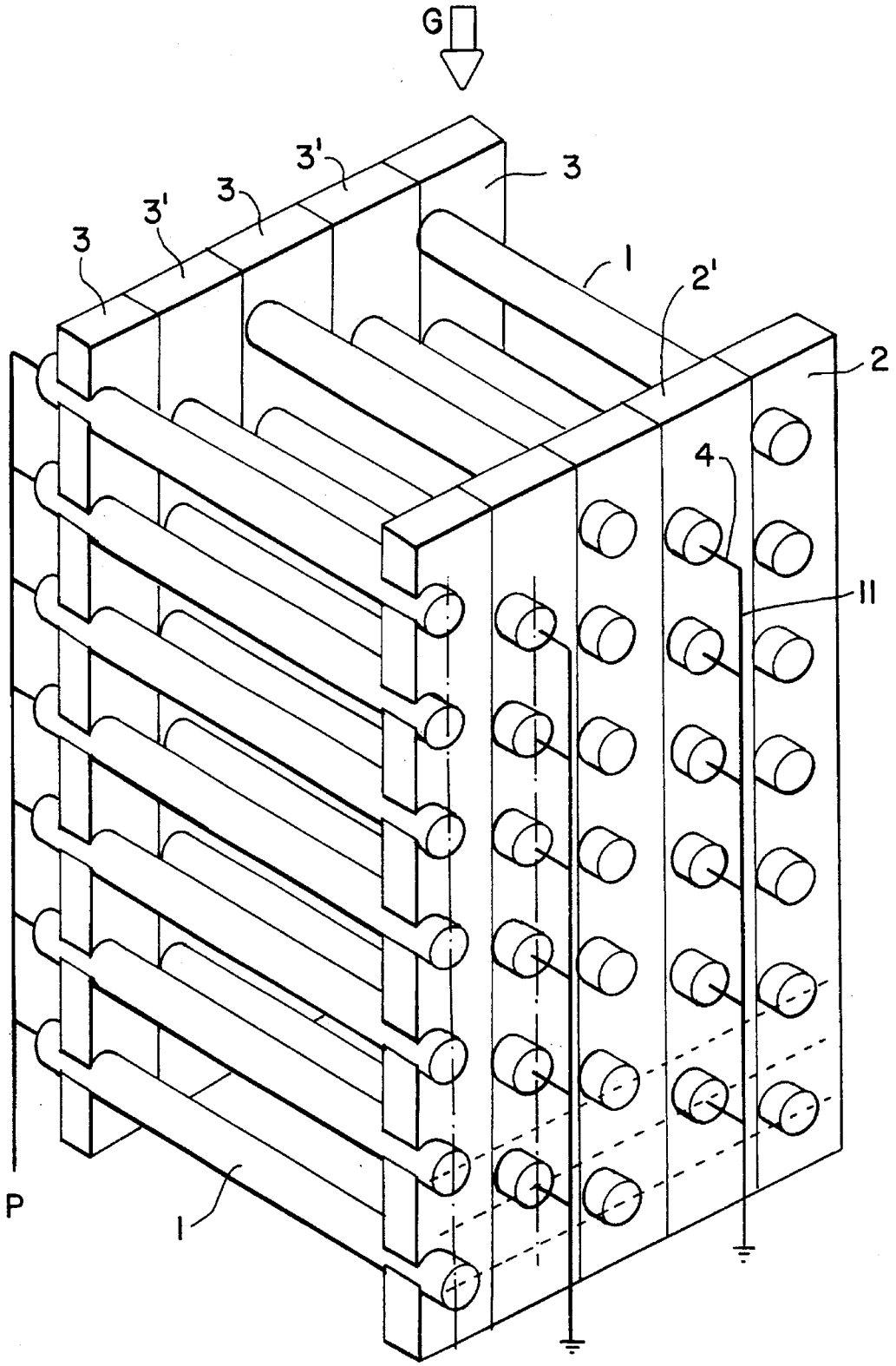
FIG. 1 is a schematic total view of a preferred embodiment.

The basic setup of a preferred embodiment of the inventive device is shown in FIG. 1.

The excitation cell shown here consists of a plurality of rod-like, horizontally arranged electrode elements 1, which are held at both ends by vertically extending crosspieces 2, 2' and 3, 3' acting as a support means. In this way the cell is divided into several modules arranged in a standing position, wherein each module consists of two opposite crosspieces and the electrode elements held equidistantly therein.

All electrode elements of a module are electrically connected via a lead 4 to a conducting bar 11. Consecutive modules are alternately connected to ground or to a phase P.

The flow of gas through the shown cell is directed downward. As it will be explained below, this reduces the influence of deposited droplets on the field distribution.

Figure 2:
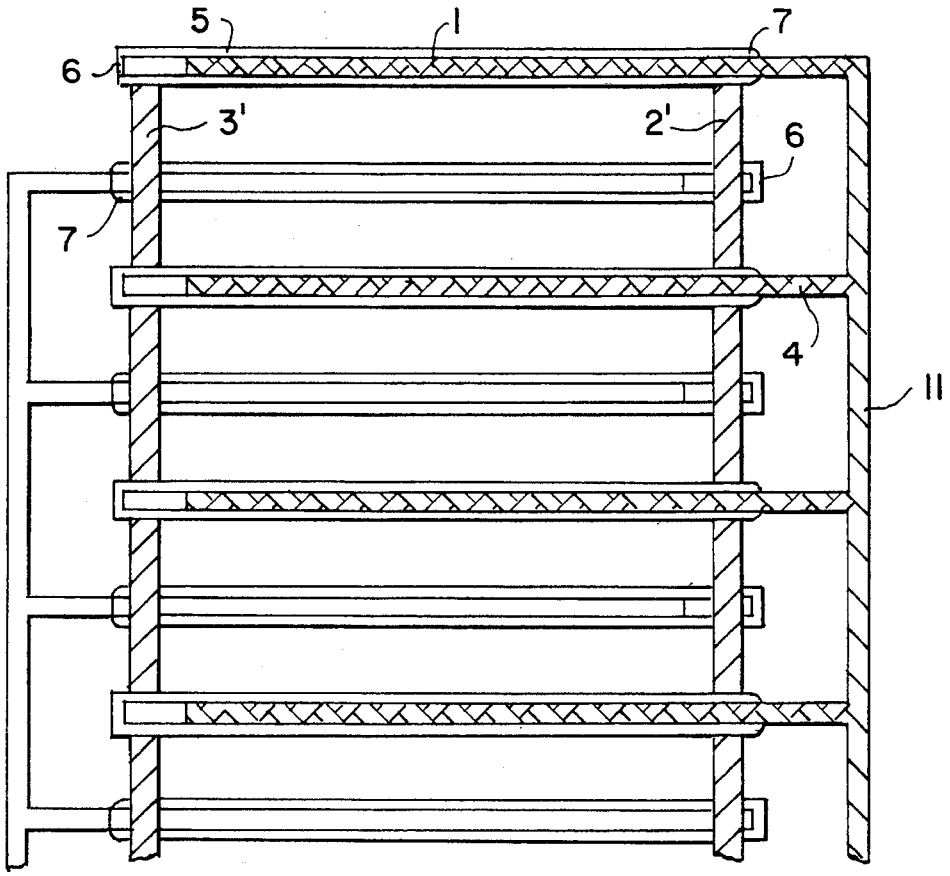
FIG. 2 is a sectional view through a module of electrode elements with the staggered next module lying behind it.

The setup of the electrode elements can be seen from FIG. 2, which shows a vertical section through a module with the next, staggered module lying behind it.

Each electrode element 1 is enclosed by a protective casing 5. The protective casing is preferably a tube of suitable diameter consisting of a chemically and thermally stable material, which also resists high electric fields and discharges. Suitable tubes are preferably made of Quartz, homogeneous ceramics or special glasses, such as borosilicate glass.

The protective casing 5 protects the electrode element 1, which consists of a conductive material, preferably a non-isolated stranded copper wire. Due to the irregular surfaces of such stranded wires it becomes possible that the discharges start from many individual surface points and not only from a few spots only (point discharge). Also, the tolerances for positioning and aligning the electrodes can be larger without affecting the homogeneity of the discharge and the field.

The protective casings 5 are closed at one end 6, while they have an opening at the other end 7 for introducing the electrode elements 1. This opening is sealed against the electrode material and impermeable to gas. Due to this design the highly reactive gas or plasma within the protective coating cannot escape into the cell where it could e.g. damage the crosspieces 2, 2', 3, 3'. The gas within the protective casings can be air or a suitable protective gas.

Figure 3:
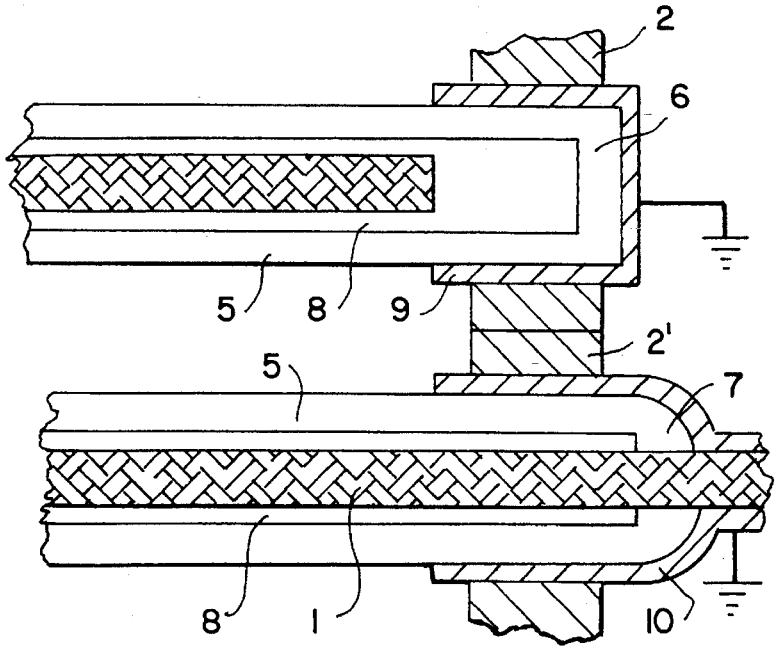
FIG. 3 is a horizontal section through two neighboring electrode elements.

The ends of the protective casings are shown in FIG. 3 in detail. This figure is a horizontal section through two electrode elements of neighboring modules and their crosspieces.

The crosspieces 2, 2', 3, 3' can be damaged if they are exposed to too high fields. Such high fields can e.g. lead to a decomposition of crosspieces based on silicone. To prevent this, the casings are preferably provided with protecting electrodes 9, 10. These can e.g. be at least weakly conductive foils, tubes or coatings, as they are known to a person skilled in the art. These protective ground electrodes are arranged as screens between the protective casings and the crosspieces.

In the present embodiment according to FIG. 3, the end 6 of one of the protective casings, the electrode element of which is connected to the phase P, is provided with a grounded screening electrode 9. The screening electrode 10 at the end 7 of the second protective casing, the electrode element of which is connected to ground, is also grounded. In this way, the field between the electrode elements in the crosspieces 2, 2' is small.

At the opposite ends of the electrode elements, in the region of the crosspieces 3, 3'(not shown), similar protective electrodes are provided, which are preferably connected to ground or another defined potential.

It is also possible that not all electrode elements and protective casings are provided with protective electrodes.

As it was already seen in FIGS. 1 and 2, neighboring modules can be arranged in staggered relation, e.g. such that each electrode element of one module is arranged at a height between the electrode elements of the neighboring module. This results in the best possible homogeneous field. This arrangement of the electrode elements can also be seen in FIG. 4, which shows a vertical section of the crosspieces.

Preferably, the cell is designed such that neighboring modules can be displaced vertically, as it is indicated by the arrows S. This makes it possible to modify the distance of the electrodes and thus the electric field and the discharge.

Figure 4:
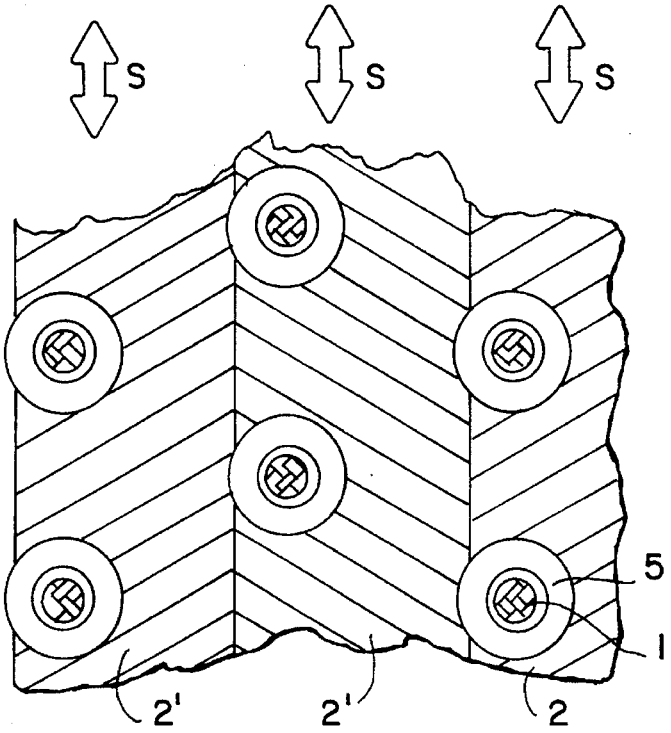
FIG. 4 is a vertical section of the supporting crosspieces.

FIG. 4 shows a possible design of the crosspieces 2, 2'. They consist of stripes of an elastic material, such as silicone. In a lateral edge of these cross pieces recesses are formed at regular distances for receiving the electrode elements and their protective casings. Due to the elasticity of the crosspieces, the protective casings are snapped into these recesses. This construction has the advantage that damaged electrode elements can be replaced easily, because they can be removed from and inserted into the crosspieces without problems. In order to facilitate the replacement of the electrode elements, the connections of the elements with the bars 11 (see FIG. 2) are of a plug-in type.

Figure 5:
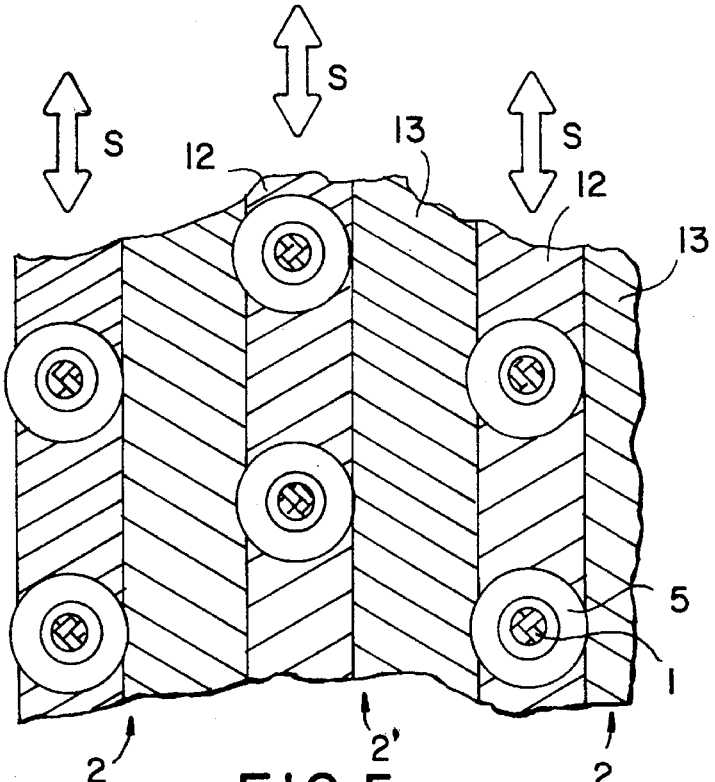
FIG. 5 is an alternative embodiment of the supporting crosspieces.

FIG. 5 shows an alternative design of the crosspieces, where they consist of a first stripe 12 and a second stripe 13, wherein the electrode elements 1 are arranged in the stripe 12. Here, stripe 12 can be made from a self-hardening, electrically isolating material cast around the protective casings 5.

Figure 6A:
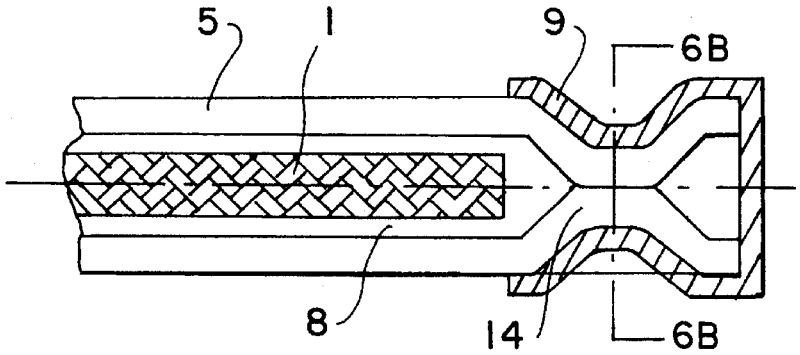
FIGS. 6A and 6B are an alternative embodiment of the end of the casings.
Figure 6B:
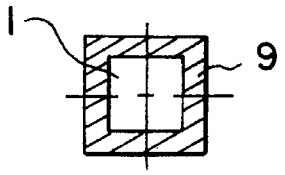
Figure 7:
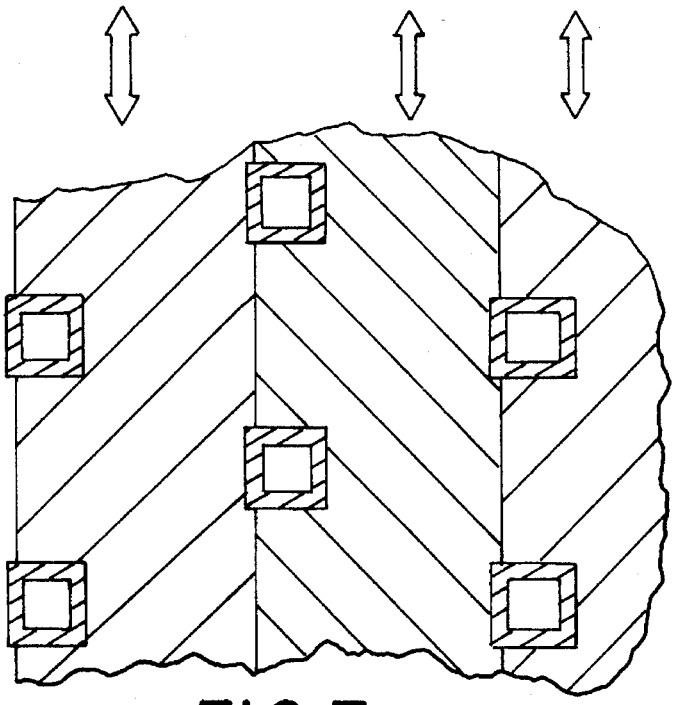
FIG. 7 is a vertical section through the crosspieces of FIG. 6.

FIG. 6 and FIG. 6A together show a possible embodiment of the end of a protective casing 5, where the tubular casing 5 was heated up and pinched for closing the tube, thereby producing a sealing termination. The cross section of the casing at the pinched point 14 can be selected by suitable choice of the pinching tool. In the presently preferred embodiment a rectangular cross section is used. FIG. 7 shows the crosspieces holding the casings of FIG. 6. Due to the waist formed by pinching the protective casings are securely held in the crosspieces.

It is, of course, also possible to close the protective casing in another way (see also FIG. 3), e.g. by melting the casings or by inserting a sealing peg.

In operation, the gas flows from the top through the cell. Because of the many individual electrode rods the gas flow is not laminar, even at low flow rates. This leads to a better mixing of the gas and a longer path of the gas through the cell, which improves the efficiency of the excitation. Furthermore, the turbulences help carrying away any material deposited on the protective casings of the electrode elements, which prevents the formation of condensate layers.

If there should remain any droplets of condensate on the protective casings, they will be collected in the bottom most part of the casings, to where they are driven by gas flow and gravity. In this bottom most part of the casings the electric fields are smallest, because electrode elements arranged on top of each other are connected to the same potential. Therefore, these droplets of condensate do not disturb the discharge.

The basic setup of FIG. 1 shows only one of the possibilities to design an inventive excitation cell. It is e.g. also possible to replace part of the electrode elements by electrode plates. Also, the electrodes can be arranged along other directions and need not necessarily be parallel.

The individual electrode elements and their protective casings need not have round cross sections. It is e.g. also possible to use oval or flattened cross sections.

In the presently preferred embodiment, each electrode element is supported by two crosspieces. It is, however, also possible to use more than two crosspieces per module. Also, the modules can have only one crosspiece and additional support can be provided by one of the bars 11.

The present invention allows to construct a modular and efficient excitation device insensitive to contamination that can be used for various applications.

While there are shown and described presently preferred embodiments of the invention, it is to be distinctly understood that the invention is not limited thereto but may be otherwise variously embodied and practiced within the scope of the following claims.

I claim:

1. A device for the excitation of vapors and gases by electric fields between electrodes consisting of a plurality of parallel, rod-shaped electrode elements, each of said electrode elements being enclosed in a protective casing and wherein gaps are formed between said protective casing for passage of said vapors and gases and wherein said electrode elements are arranged in modules, each module comprising a plurality of parallel electrode elements arranged in a plane and at least one elongate support means for holding all said electrode elements of said module.

2. The device of claim 1, wherein all electrode elements of each module are electrically interconnected.

3. The device of claim 1 comprising a plurality of said modules arranged side by side.

4. The device of claim 1 comprising a plurality of said modules arranged side by side, wherein said modules are alternatedly connected to a first and a second electric potential such that neighboring modules are connected to different electric potentials.

5. The device of claim 4, wherein all electrode elements are arranged equidistantly.

6. The device of claim 1, wherein said at least one support means is mechanically connected to said protective casings of said electrode elements, wherein shield means for reducing an electrical field within said support means are arranged between at least a part of said protective casings and the support means.

7. The device of claim 1, wherein said protective casings consist at least partially of a ceramic.

8. The device of claim 1, wherein said protective casing consist at least partially of a glass.

9. A device for the excitation of vapors and gases by electric fields between electrodes consisting of a plurality of parallel rod-shaped electrode elements, each of said electrode elements being enclosed in a protective ceramic casing and wherein gaps are formed between said protective ceramic casings for passage of said vapors and gases.

10. A device for the excitation of vapors and gases by electric fields between electrodes, wherein said electrodes consisting of a plurality of parallel rod-shaped elements, each of said electrode elements being enclosed in a protective glass casing, and wherein gaps are formed between said protective glass casings for passage of said vapors and gases.

* * * * *